US006237826B1

(12) United States Patent
Gould

(10) Patent No.: US 6,237,826 B1
(45) **Date of Patent: *May 29, 2001**

(54) SAFETY SIDE-RELEASE BELT BUCKLE

(75) Inventor: Bernard B. Gould, Lillington, NC (US)

(73) Assignee: Gould & Goodrich Leather, Inc., Lillington, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,223

(22) Filed: Apr. 28, 1998

(51) Int. Cl.[7] ..... F41C 33/02; A44B 11/25

(52) U.S. Cl. ..... 224/660; 24/615; 24/625; 224/911; 224/912

(58) Field of Search ..... 224/660, 911, 224/912; 24/625, 615, 616

(56) References Cited

U.S. PATENT DOCUMENTS

| | | | |
|---|---|---|---|
| 1,737,246 | 11/1929 | Jones . | |
| 3,430,306 | 3/1969 | Tareau . | |
| 4,408,375 | 10/1983 | Skobel . | |
| 4,534,090 | 8/1985 | Skobel . | |
| 4,624,033 | 11/1986 | Orton . | |
| 4,912,950 | 4/1990 | Crowle . | |
| 5,322,037 | 6/1994 | Tozawa . | |
| 5,331,726 | 7/1994 | Suh . | |
| 5,383,257 | 1/1995 | Krauss . | |
| 5,443,039 | 8/1995 | Suchowski . | |
| 5,551,131 * | 9/1996 | Anscher | 24/625 |

* cited by examiner

*Primary Examiner*—Stephen P. Garbe
(74) *Attorney, Agent, or Firm*—David J. Powsner; Nutter, McClennen & Fish LLP

(57) ABSTRACT

An improved side-release belt buckle has a male part with a resilient member and a female part with a cavity for releasably securing the resilient member, wherein the female part has a buckle-release aperture on a side (e.g., the top of the buckle) whose geometric normal is substantially aligned with a surface of the wearer's body. The aperture being substantially free of extension into a side (i.e., the front face of the buckle) that has a normal directed away from the wearer's body. The invention has application to saftey buckles for use in strapping firearm holsters and other articles to wearers.

17 Claims, 3 Drawing Sheets

SAFETY SIDE-RELEASE BELT BUCKLE

BACKGROUND OF THE INVENTION

The invention pertains to belt buckles and and, more particularly, to saftey buckles for use in strapping firearm holsters and other articles to wearers.

The advent of nylon and other synthetic webbing has prompted the development of lightweight, strong belts. Nylon belts, for example, are now commonly used by police, correctional officers, or other law enforcement and safety officers to holster or strap on side arms and other articles. The further development of injection molded, side-release belt buckles has provided a fast and ready mechanism for engagement and disengagement of the ends of such belts. These buckles are now almost universally accepted for use in conjunction with lightweight webbing belts in law enforcement, recreational, and other applications.

The use of side-release belt buckles by law enforcement officials and safety officers, among others, remains a source of concern, however. Though the buckles can be used to quickly attach a gun holster, walkie-talkie or other implement to the wearer, there is fear that the buckle will be inadvertently released, e.g., if the wearer unknowingly presses on one of the buckle release tabs. In emergency and rescue situations, there is also a risk that the victim will mistakenly grab and press the tabs, causing the buckle to release. Of equal concern, in law enforcement applications, is the possibility that an assailant or struggling prisoner could release the buckle and gain an embarrassing, if not dangerous, advantage.

Many buckle manufacturers have added additional saftety-release mechanisms to existing side-release belt buckles designs to make inadvertent or unwanted release of the buckle more difficult. Unfortunately, the workings of these mechanisms may be known or readily apparent to an assailant, rendering the buckles less secure. Moreover, the mechanisms typically make it more difficult and troublesome for the wearer to remove the buckle intentionally. Still further, the prior art designs may require more expensive and complicated molds, making the buckles more expensive to produce.

In view of the foregoing, an object of the invention is to provide an improved safety buckle and, more particularly, to provide an improved side release-style safety belt buckle.

A further object of the invention is to provide a side release-style safety belt buckle that can be readily engaged and disengaged by the wearer when desired, but that cannot be unintentionally or unwantedly disengaged, e.g., by someone other than the wearer.

Yet a still further object of the invention is to provide a side release-style safety belt buckle that is strong, long-lasting, reliable and that can be manufactured at low expense.

Still yet a further object of the invention is to provide a side release-style safety belt buckle that can be used in law enforcement, safety, recreational and other application where inadvertent or unwanted buckle release is not desireable.

SUMMARY OF THE INVENTION

These and other objects of the invention are met by the invention which provides a side-release belt buckle in which apertures, or "cut-aways," on the sides of the female portion are concealed and covered from the front, thereby preventing the tabs of the male portion of the assembled buckle from being pressed by anyone other than the wearer.

The invention provides, in one aspect, an improved side-release belt buckle of the type having a male part with a resilient member and a female part with a cavity for releasably securing the resilient member. The female part has a buckle-release aperture on a side (e.g., the top) whose geometric normal is substantially aligned with that surface of the wearer's body against which the buckle rests. The improvement is characterized by the aperture being substantially free of extension into a side of the buckle (i.e., the front face) that has a normal directed away from the wearer's body.

A related aspect of the invention provides an improved side-release buckle of the type described above wherein the aperture extends at least partially into a side (i.e., the back) that faces toward, or rests against, the wearer's body.

In other related aspects, the invention provides a side-release belt buckle of the type described above in which apertures are provided on two sides whose normals are substantially aligned with a surface of the wearer's body (i.e., the top and bottom of the buckle). As above, though either aperature can extend into the side that faces toward the wearer's body (e.g., the back of the buckle), both apertures are substantially free from extension into the side that has a normal directed away from the wearer's body (i.e., the front face of the buckle).

Still further aspects of the invention provide securement systems comprising an article, such as a gun holster, walkie talkie or other article disposed on a belt, the ends of which are secured via a side-release buckle of the type described above.

Side-release belt buckles and securement systems according to the invention provide a number of advantages over the prior art. At the outset, they reduce or eliminate the possibility of inadvertent release by the wearer, e.g., as he or she leans up against a fence or bellies up to the bar. They also prevent an assailant, or any other person approaching the wearer from the front, from conveniently squeezing and releasing the buckle. Moreover, since the apertures are covered from the front, the release tabs are shielded from the view of the casual observer or assailant. At the same time, however, the release tabs can be conveniently pressed by the wearer who places the palm of his or her hand in a natural position against the face of the buckle.

These and other aspects and advantages of the invention are evident in the drawings and in the description that follows.

BRIEF DESCRIPTION OF THE INVENTION

A more complete understanding of the invention may be attained by reference to the drawings, in which.

DETAILED DESCRIPTION OF THE ILLUSTRATED EMBODIMENTS

Figure 1A:
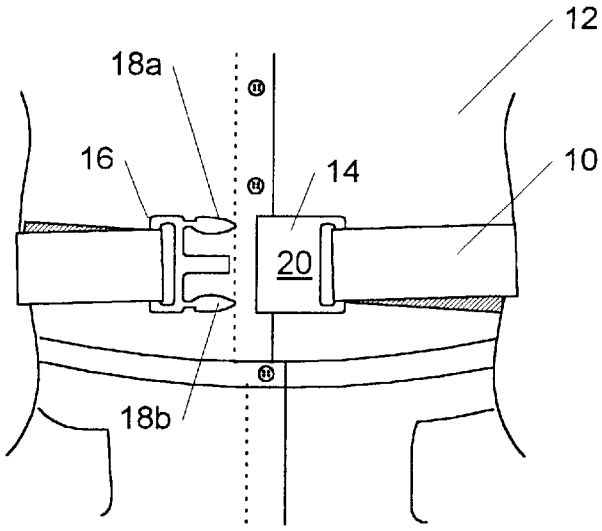
FIGS. 1A–1C are front views showing attachment, around a wearer, of a belt incorporating a side-release buckle according to the invention.
Figure 1B:
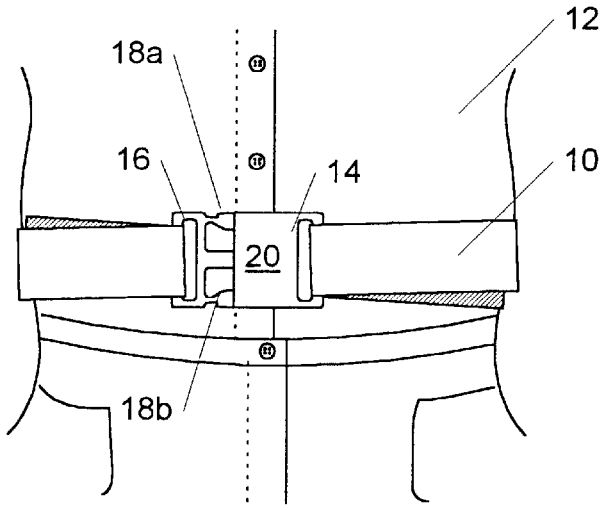
Figure 1C:
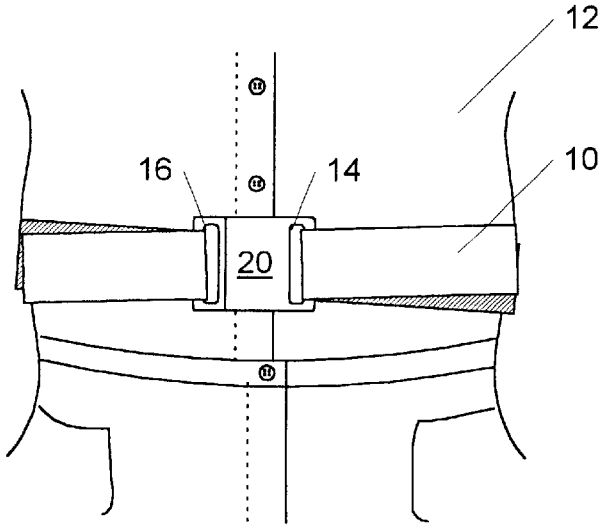

FIG. 1A–1C depict attachment of a belt 10 to a wearer 12 by use of a side-release belt buckle according to the invention. Preferably, there is affixed or otherwise disposed on the belt, though not shown in the drawing, a gun holster, walkie-talkie or other article.

The buckle has a female part 14 and male part 16. The former includes a cavity, not shown, for releasably securing a resilient portion of the male part 16. That reslient portion, in the illustrated embodiment, comprises a pair of tabs or ears 18*a*, 18*b* that flex toward one another under compression. Those skilled in the art will appreciate that other practices of the invention may utilize fewer or more such tabs and/or may utilize resilient portions of other configurations altogether.

The male and female halves 14, 16 are preferably formed from a common injection molded plastic, though metals and other materials may be used instead. As with male halves of conventional side-release buckles, the tabs 18*a*, 18*b* are preferably of the cast-in-place variety, though they may be separately formed and affixed onto the body of the male half if desired. As with conventional female halves of side-release buckles, the cavity can include cast recesses that—along with, or instead of, side apertures—facilitate capture of the tabs.

As shown in the illustration, the male half 16 includes an end loop through which an end portion of a belt is passed, folded back upon itself and fastened with a convenient fastening mechanism so that the belt end remains securely fastened and prevented from slipping out of the buckle loop area. The male half 18 may also include a central protuberance, of a variety of cross sections, provided for the purpose of slidably engaging a cavity of corresponding shape enclosed within the female portion of the buckle to facilitate proper alignment of the male and female halves. The tabs 18*a*, 18*b* may include a stepped or recessed area which engages a correspondingly shaped side wall portion of the female member in such a manner as to restrain the male member of the set within the female member of the set until these tabs are depressed or resiliently deformed toward the center line sufficiently to allow the tabs to slidably disengage from the side wall of the female half 14.

The female half 14 is preferably in the form of a hollow rectangular tube that is closed at one end and that includes a belt loop similar to that provided in the male half The female portion can include an internal central guide rail or tube to slidably receive the corresponding protuberance on a male portion of the buckle set to align the two buckle halves. The outer rectangular shell comprising the sides of the female half 14 are sized to receive snugly the resilient portion of male half As discussed below, the top and bottom side walls of the female half are cut away in such a manner that the tabs 18*a*, 18*b* of the male half, which are elastically depressed as the male portion enters the female portion, will elastically spring into the cut away area in such a manner that the step or recess in said tabs will engage the edge of the cut-away wall area and prevent subsequent withdrawal of the male portion, i.e., until the tabs are depressed sufficiently to allow them to pass beneath the is edge of the cutaway areas of the side wall.

The buckle is secured by sliding the resilient portion of the male half 16 into the female half 14. The cavity of the female half 14 has a smaller cross-section than that of the resilient portion of the male half Hence, as the tabs 18*a*, 18*b* begin enter the cavity, they are compressed. See FIG. 1B. When the buckle is fully secured, as shown in FIG. 1C, the tabs become aligned with apertures (see FIG. 2) in the top and bottom sides of the female half 14. In this position, they expand away from one another or reopen toward their relaxed state, thus releaseably securing the male half 16 in the female half 14.

As with prior art side-release belt buckles, the male and female halves 14, 16 are separated or disengaged from one another by the wearer 12 compressing a resilient portion of the male half 16—and, more particularly, by squeezing tabs 18*a*, 18*b* —to release it from securement in the female half 14. To prevent inadvertent release by the wearer or purposeful release by an assailant, while still allowing convenient purposeful release by the wearer, the front face 20 of the female half 14 covers the release apertures from view or access from the front.

Figure 2A:
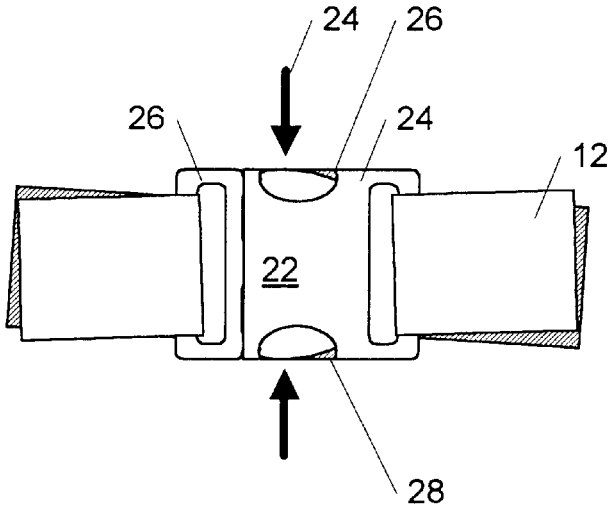
FIGS. 2A–2C are back views showing engagement of a side-release buckle according to the invention.
Figure 2B:
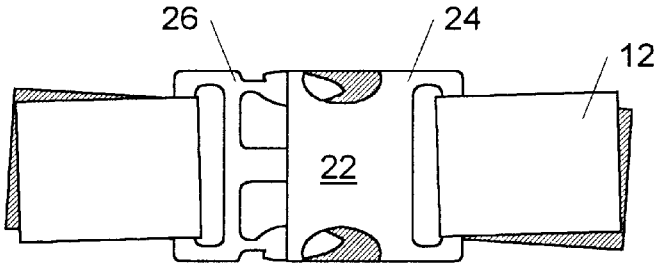
Figure 2C:
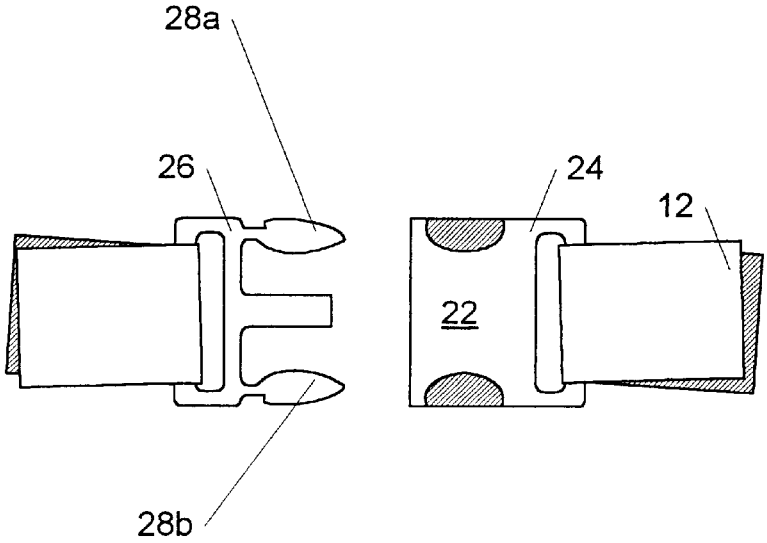

FIGS. 2A–2C show disengagement of a side-release belt buckle according to the invention. Referring to FIG. 2A, the assembled buckle is disengaged by pressing on the tabs 18*a*, 18*b* to compress them toward one another. This is illustrated by force vectors 24. The wearer, who typically presses on the tabs with the fingers of a hand whose palm rests naturally against the front 20 of the buckle, accesses the tabs via apertures 26, 28 in the top and bottom sides of the female half As shown in the illustration, those apertures 26, 28 preferaby extend into the back side 22 of the female half sufficiently to allow the wearer's fingers to compress the tabs for disengagement. Thus, the wearer by virtue of the natural angle of placement of his or her own hand upon the face of the buckle with his or her hands resting with the thumbs up and fingers generally pointing toward the bottom of the buckle when worn, is able conveniently to depress the otherwise concealed tabs sufficiently to allow purposeful disengagement.

The apertures need not extend too far into the back side 22, since it is preferable to prevent the wearer from over-compressing the tabs and, thereby, breaking them or quickly wearing them out. Conversely, as noted above, the apertures 26, 28 preferably do not extend into the front side 20 of the female half However, in embodiments where it proves desirable to extend those apertures into the front side 20 (e.g., for the wearer's comfort), such extension should be slight and, in any event, not sufficient to enable fingers or other objects pressing from the front to compress the tabs sufficiently for disengagement. In embodiments where the top and bottom sides of the female half 14 are sufficiently wide for the wearer's fingers, it is not necessary to extend the apertures 26, 28 even into the back side 22.

Figure 3:
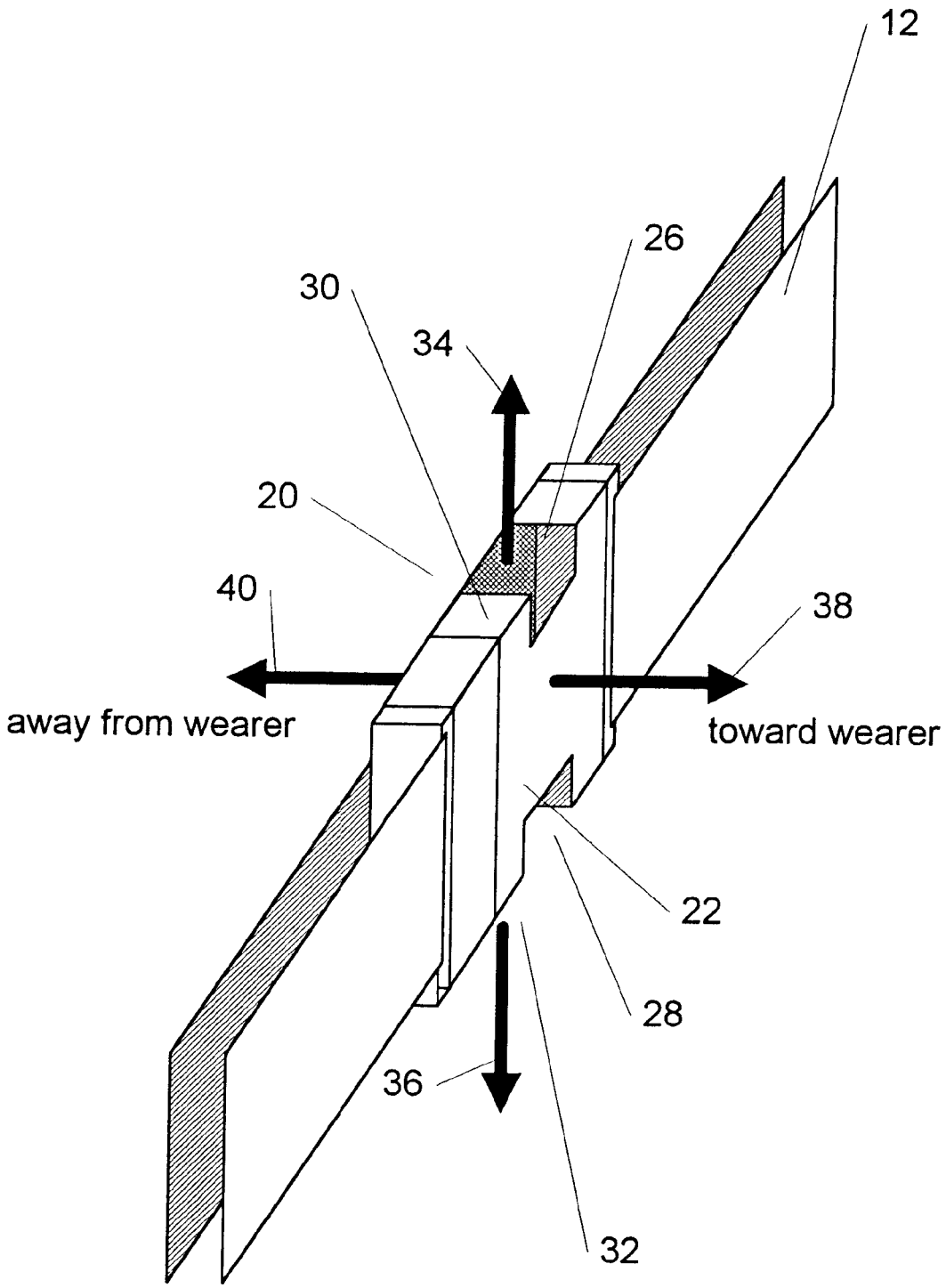
FIG. 3 is a perspective view of a side-release buckle according to the invention.

FIG. 3 shows a perspective view of a side-release buckle according to the invention. The illustration particularly shows the apertures 26, 28 disposed in top and bottom sides 30, 32 of the female half and extending into the back 22, while not extending into the front 20. The illustration also shows how the geometric normals 34, 36 of the top and bottom sides 30, 32 are directed substantially parallel to the surface of the portion of the wearer's body on which the buckle rests. On the other hand, the normal 38 of the back side 22 is directed toward the wearer, while the normal 40 of the front side 20 is directed away from the wearer.

Illustrated herein and described above is a side-release belt buckle and belt system meeting the objects set forth above. The illustrated embodiment, for example, provides a side-release belt buckle with a recessed area provided only on top, bottom and rearmost face of the buckle assembly, allowing unfettered finger access to the release tabs by only the wearer. The face or front portion of the engaged buckle conceals the tabs from view and prevents their compression from that direction. This prevents inadvertent or unwanted disengagement of the buckle by persons or objects other than the wearer, whose whose hands are so situated as to be able to present direct downward and upward force simultaneously upon the fully engaged release tabs. The natural hand position of only a wearer of such a safety buckle will allow the wearer to apply the required release pressure with little or no unnatural effort.

Those skilled in the art will, of course, appreciate that the embodiment is shown merely as an example and that the invention may be utilized in connection with other side-release configurations, e.g., by way of non-limiting example, those utlizing only a single tab.

In view of the foregoing, what I claim is:

1. In a side-release belt buckle of the type having a male part having a resilient member, a female part having a cavity for releasably securing the resilient member, the female part having an aperture in a side that has a normal substantially parallel to a wearer's body surface on which the buckle is disposed, the aperture permitting the resilient member to be flexed for release from securement, the improvement wherein the aperture is substantially free of extension into a front of the female part, wherein the front of the female part is a side that has an outside face with a normal directed away from the wearer's body surface on which the buckle is disposed, the front of the female part substantially preventing the resilient member from being flexed for release from securement, except by the wearer, and the resilient member of the male part having one or more tabs or ears that are concealed from view by the front of the female part one of the tabs or ears being accessible to the wearer through the aperture to permit release from securement.

2. In a side-release belt buckle according to claim 1, the further improvement wherein the aperture extends at least partially into a back of the female part, wherein the back of the female part is a side that has an outside face with a normal directed toward the body surface on which the buckle is disposed.

3. In a side-release belt buckle according to claim 1, the further improvement wherein the front of the female part substantially prevents the resilient member from being flexed for release from securement, except when a palm of the wearer's hand is placed against the front of the female part.

4. A side-release belt buckle comprising a male part having a plurality of resilient members, a female part having a cavity for releasably securing the resilient members, the female part having a first aperture in a first side that has a normal substantially parallel to a wearer's body surface on which the buckle is disposed, the female part having a second aperture in a second side that has a normal substantially parallel to the body surface on which the buckle is disposed, the apertures permitting the reslient member to be flexed for release from securement, the apertures being substantially free of extension into a front of the female part, wherein the front of the female part is a side that has an outside face with a normal directed away from the body surface on which the buckle is disposed, the front of the female part substantially preventing the resilient member from being flexed for release from securement, except by the wearer and the resilient member of the male part having one or more tabs or ears that are concealed from view by the front of the female part one of the tabs or ears being accessible to the wearer through the aperture to permit release from securement.

5. A side-release belt buckle according to claim 4, the wherein at least one of the apertures extends at least partially into a back of the female part, wherein the back is a side of the female part having an outside face with a normal directed toward the body surface on which the buckle is disposed.

6. A side-release belt buckle according to claim 4, wherein the front of the female part substantially prevents the resilient member from being flexed for release from securement, except when a palm of the wearer's hand placed against the front of the female part.

7. A side-release belt buckle comprising a male part having a resilient portion, a female part having a cavity sized such that insertion of the resilient portion of the male part a first distance into the cavity places the resilient portion under compression, the female part having one or more apertures in one or more respective sides with normals substantially parallel to a wearer's body surface on which the buckle is disposed, whereby insertion of the resilient portion of the male part a further distance into the cavity aligns at least a region of the resilient portion with the apertures to relieve at least some of the compression in the resilient portion, thereby, releasably securing the reslient portion within the female part, the apertures being substantially free of extension into a front of the female part, wherein the front of the female part is a side that has an outside face with a normal directed away from the body surface on which the buckle is disposed, the front of the female part substantially preventing the resilient member from being flexed for release from securement, except by the wearer and the resilient member of the male part having one or more tabs or ears that are concealed from view by the front of the female part one of the tabs or ears being accessible to the wearer through the aperture to permit release from securement.

8. A side-release belt buckle according to claim 7, wherein the apertures extend at least partially into a back of the female part, wherein the back of the female part is a side that has an outside face with a normal directed toward the body surface on which the buckle is disposed.

9. A side-release belt buckle according to any of claims 7 or 8, wherein the apertures are sized to permit the wearer's fingers to compress the resilient portion of the male part to release it from securement.

10. A side-release belt buckle according to claim 7, the further improvement wherein the front of the female part substantially prevents the resilient member from being flexed for release from securement, except when a palm of the wearer's hand placed against the front of the female part.

11. In gun holstering system of the type having a holster, a belt and a side-release belt buckle for securement thereof, the buckle having a male part having a resilient member, a female part having a cavity for releasably securing the resilient member, the female part having an aperture in a side that has a normal substantially parallel to a wearer's body surface on which the buckle is disposed, the aperture permitting the resilient member to be flexed for release from securement, the improvement wherein the aperture is substantially free of extension into a font of the female part, wherein the front of the female part is a side that has an outside face with a normal directed away from the body surface on which the buckle is disposed, the front of the female part substantially preventing the resilient member from being flexed for release from securement, except by the wearer, and the resilient member of the male part having one or more tabs or ears that are concealed from view by the front of the female part one of the tabs or ears being accessible to the wearer through the aperture to permit release from securement.

12. In a gun holstering system according to claim 11, the further improvement wherein the aperture extends at least partially into a back of the female part, wherein the back of the female part is a side that has an outside face with a normal directed toward the body surface on which the buckle is disposed.

13. In a gun holstering system according to claims 11, the further improvement wherein the front of the female part substantially prevents the resilient member from being flexed for release from securement, except when a palm of the wearer's hand placed against the front of the female part.

14. A gun holstering system comprising

A. a holster,

B. a belt on which the holster is disposed,

C. a side-release belt buckle comprising i) a male part disposed on a first end of the belt, the male part having a resilient portion, ii) a female part disposed on a second end of the belt, the female part having a cavity sized such that insertion of the resilient portion of the male part a first distance into the cavity places the resilient portion under compression, iii) the female part having one or more apertures in one or more respective sides with normals substantially parallel to a wearer's body surface on which the buckle is disposed, iv) whereby insertion of the resilient portion of the male part a further distance into the cavity aligns at least a region of the reslient portion with the apertures to relieve at least some of the compression in the resilient portion, thereby, releasably securing the reslient portion within the female part, v) the apertures being substantially free of extension into a front of the female part, wherein the front of the female part is a side that has an outside face with a normal directed away from the body surface on which the buckle is disposed, the front of the female part substantially preventing the resilient member from being flexed for release from securement, except by the wearer, and, the resilient member of the male part having one or more tabs or ears that are concealed from view by the front of the female part one of the tabs or ears being accessible to the wearer through the aperture to permit release from securement.

15. A gun holstering system according to claim 14, wherein the apertures extend at least partially into a back of the female part, wherein the back of the female part is a side that has an outside face with a normal directed toward the body surface on which the buckle is disposed.

16. A gun holstering system according to any of claims 14 or 15, wherein the apertures are sized to permit the wearer's fingers to compress the resilient portion of the male part to release it from securement.

17. A gun holstering system according to claim 16, the further improvement wherein the front of the female part substantially prevents the resilient member from being flexed for release from securement, except when a palm of the wearer's hand placed against the front of the female part.

* * * * *

UNITED STATES PATENT AND TRADEMARK OFFICE

CERTIFICATE OF CORRECTION

PATENT NO. : 6,237,826 B1
DATED : May 29, 2001
INVENTOR(S) : Gould

It is certified that error appears in the above-identified patent and that said Letters Patent is hereby corrected as shown below:

Column 7,
Line 1, please delete "font"; and insert therefor -- front --.
Line 20, please delete "claims"; and insert therefor -- claim --.

Signed and Sealed this

Fifteenth Day of January, 2002

*Attest:*

*Attesting Officer*

JAMES E. ROGAN
*Director of the United States Patent and Trademark Office*